10/22/85 XR 4,548,621

United States Patent [19]

Eriksson et al.

[11] Patent Number: 4,548,621

[45] Date of Patent: Oct. 22, 1985

[54] CONDENSING ZINC VAPOR

[75] Inventors: Sune Eriksson; Börje Johansson; Sven Santén, all of Hofors, Sweden

[73] Assignee: SKF Steel Engineering AB, Sweden

[21] Appl. No.: 698,750

[22] Filed: Feb. 6, 1985

Related U.S. Application Data

[63] Continuation of Ser. No. 460,351, Jan. 24, 1983, abandoned.

[30] Foreign Application Priority Data

Jun. 21, 1982 [SE] Sweden ..... 8203830

[51] Int. Cl.[4] ..... B01D 47/00

[52] U.S. Cl. ..... 55/72; 55/85; 55/89; 55/228; 75/88; 261/116; 261/117

[58] Field of Search ..... 55/72, 85, 89, 228; 75/88; 261/116, 117

[56] References Cited

U.S. PATENT DOCUMENTS

| | | |
|---|---|---|
| 1,977,107 | 10/1934 | Agronofsky . |
| 2,238,819 | 4/1941 | Neve . |
| 2,598,116 | 5/1952 | Du Bois . |
| 2,671,725 | 3/1954 | Robson et al. . |
| 2,849,083 | 8/1958 | Nelson et al. . |
| 3,841,862 | 10/1974 | Benatt et al. . |

FOREIGN PATENT DOCUMENTS

| | | |
|---|---|---|
| 905320 | 3/1943 | Fed. Rep. of Germany . |
| 47491 | 11/1972 | Japan . |
| 572961 | 10/1945 | United Kingdom . |
| 572960 | 10/1945 | United Kingdom . |
| 138753 | 2/1960 | U.S.S.R. . |

*Primary Examiner*—Bernard Nozick

*Attorney, Agent, or Firm*—Brumbaugh, Graves, Donohue & Raymond

[57] ABSTRACT

Recovery of zinc from a gas containing zinc vapor is carried out by means of lead circulating in a circuit and separating out pure metallic zinc by cooling said lead. The gas containing zinc vapor is brought into intimate contact with atomized lead in liquid form which takes up the zinc. The lead is introduced at the top of a cooling tower (1) and the gas is conducted in counter-flow to the atomized lead droplets. Lead collected at the bottom of the tower (1) is transported (7) to a separating chamber (8) where it is cooled, so that the zinc is segregated from the lead and can be separated (10). The lead is then cooled further before being recirculated (15, 16) to the top of the cooling tower.

16 Claims, 3 Drawing Figures

CONDENSING ZINC VAPOR

Figure 1:
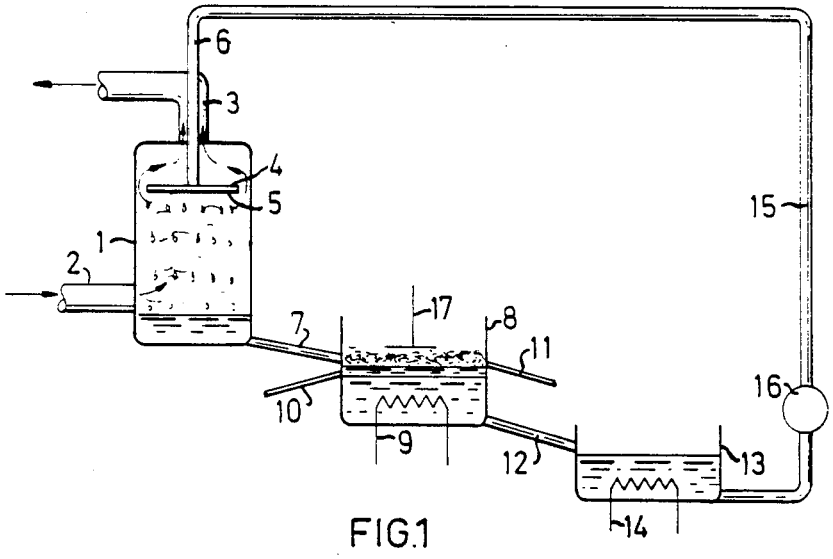

This application is a continuation of application Ser. No. 460,351, filed on Jan. 24, 1983, now abandoned.

DESCRIPTION

The invention relates to a method and means for recovering zinc from a gas containing zinc vapour, by collecting zinc vapour by means of lead circulating in a circuit and separating out pure metallic zinc by cooling said lead.

In the recovery of zinc a gas is obtained which contains varying concentrations of zinc vapour. The recovery of this zinc vapour and its conversion to pure metallic zinc is a complicated process.

Currently there are essentially two different types of processes for cooling and condensing zinc vapour. When the plant known as St. Joe's furnace is used for generating zinc vapour, a gas is obtained which contains about 40% zinc vapour and is only slightly over-heated. The heat to be removed is thus to a great extent the condensation heat of the zinc. A bubble condensor is used for this, so named because the gas is caused to bubble through a bath of liquid zinc. The zinc circulates in the condensor, which has no movable parts in the gas passage, and is allowed to pass through a trough containing elements filled with water which are immersed in the zinc and act as final absorbers of the heat contained in the gas. The condensor is simple, but the contact area between gas and cooling zinc in the condensor is small.

When zinc vapour is generated by means of Imperial Smelting Furnaces, a more over-heated gas is obtained which contains only about 6% zinc. A condensor of considerably more complicated type must then be used since the condensation heat of the zinc comprises only a fraction of the heat to be cooled away, and also because the gas contains CO, $CO_2$, $N_2$ and zinc vapour. The gas must therefore be cooled quickly to prevent the undesired reoxidation to ZnO through reaction between gaseous zinc and carbon dioxide. The contact surface between cooling medium and gas must therefore be extremely large. A "splash-condensor" is therefore used, in which large quantities of lead circulate. The lead is whisked by large whisks, the gas caused to pass through the whisked lead, and the zinc thus dissolves in the lead. About 400 ton lead must circulate for every ton of zinc recovered.

Neither of the processes described is particularly suitable for recovering zinc from a gas which is generated by direct reduction of a material containing zinc in a shaft furnace. This process can be used for a number of different raw materials such as ore concentrates containing up to 50% ZnO and 10% PbO, or dust from other processes which may sometimes contain only a few percent ZnO. As a rough approximation, 1% Zn is obtained in the gas for every % Zn in the starting material.

The present invention provides a method suitable for condensation of zinc vapour within a wide concentration range and which permits simple removal of dross, by (1) bringing the gas containing zinc vapour into intimate contact with atomized lead in liquid form which is introduced at the top of at least one cooling tower, in at least one step, (2) separating zinc contained in the lead in the form of pure liquid, metallic zinc in a separating chamber by means of segregation and (3) recirculating lead from which the zinc has been removed after further cooling.

According to a preferred embodiment of the invention, the gas containing zinc vapour is brought into contact with atomized lead in at least two steps. The gas can thus be conducted in the direction of flow of the atomized lead in the first step and in counter-flow in the second step, or in counter-flow in both steps.

According to a second embodiment of the invention, the lead from the two cooling steps is collected jointly.

According to yet another embodiment of the invention the cooled lead is recirculated in such a way that it shows a positive temperature gradient in the recirculating pipe, seen in the direction of flow, preferably by the recirculation pipe being carried through the gas inlet pipe and/or gas outlet pipe to the cooling tower(s).

The means or apparatus for performing the method according to the invention is principally characterised by at least one cooling tower with inlet and outlet for the gas containing zinc vapour, a supply means for the supply of atomized liquid lead to the upper part of the cooling tower, a collection area at the lower part of the tower, having an outlet for the lead collected, a separating chamber connected to the outlet for separating liquid metallic zinc and dross from the lead, followed by a cooling chamber to further cool the lead, and a pipe provided with a pump to return the lead to the top of the cooling tower.

According to a preferred embodiment the apparatus comprises two separate cooling towers or one cooling tower divided into two separately functioning cooling chambers, having separate supply means for liquid, atomized lead at their tops, but a common collecting area for the lead, the gas inlet to the first cooling tower or the first chamber, seen in the direction of flow of the gas, being arranged in the upper part of the tower and the outlet in its lower part, while the gas inlet for gas from the first tower or first chamber is arranged in the lower part of the second tower or second chamber and the gas outlet for the second tower or chamber is arranged in its upper part, so that the gas will be transported in the direction of flow of the descending lead in the first tower or chamber and against the direction of flow in the second cooling tower or chamber.

Furthermore, the recirculation pipe for the lead is preferably arranged partially in the inlet/outlet pipes for the gas in the cooling tower or chamber. This means that a positive temperature gradient for the lead in the recirculation pipe is achieved and, even if the temperature increase in the lead in the pipe is only 10° C., this ensures that dross will not be precipitated when the lead is sprayed into the cooling tower. Clogging would otherwise be unavoidable if nozzles are used.

The lead can be atomized by means of a plurality of nozzles connected to the recirculation pipe. Alternatively a splash surface is used, against which the lead falls, is pumped or sprayed, where extremely fine droplets of molten lead can be obtained by adjustment of quantity and vertical fall. A rotary means, such as a rotating disc throwing out drops of lead may also be used.

Figure 3:
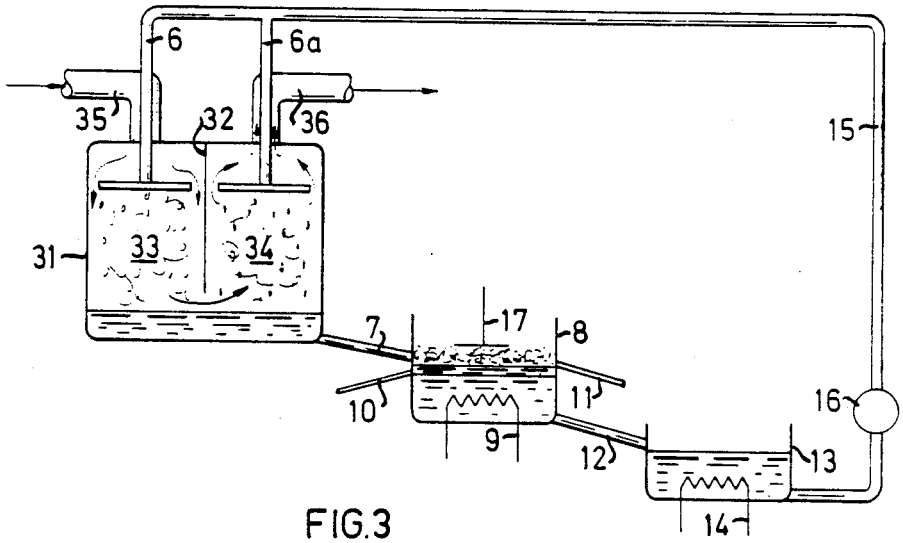
Figure 2:
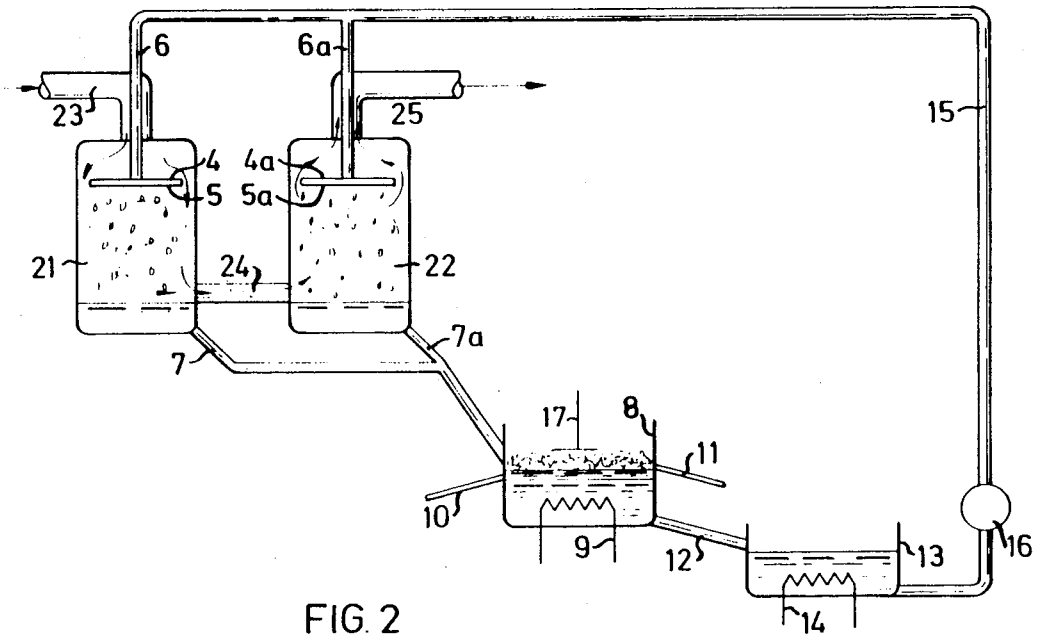

Further characteristics and advantages of the invention will be revealed in the following detailed description with reference to the accompanying drawings in which FIG. 1 shows a schematic view of equipment for performing the method according to the invention with one cooling tower, FIG. 2 shows a second embodiment of the equipment with two separate cooling towers, and FIG. 3 shows a third embodiment of the equipment with one cooling tower comprising two separate chambers, but with common collection of the lead.

FIG. 1 shows schematically an embodiment of the apparatus for performing the condensing process according to the invention. In a tower 1 with inlet 2 and outlet 3 for gas containing zinc vapour, a supply means 4 is arranged for atomized liquid lead. The figure shows nozzles or jets 5, but other means are also feasible. Supply pipe 6 through which the lead is supplied to the nozzles, is preferably arranged to run through part of the outlet 3 and extend some way into the tower 1.

The cooling tower 1 is connected via a pipe 7 to a separating chamber 8. A cooling loop 9 is arranged in this chamber, as well as outlet pipes 10, 11 and 12. The pipe 12 leads to a second chamber 13, also provided with a cooling loop 14. This chamber 13 is preferably at a level below the level of the chamber 8.

A pipe 15 connects the chamber 13 with the supply pipe 6 arranged in the exhaust outlet. A pump 16 is arranged in the pipe 15. A rake 17 or the like is also arranged in the chamber 8 for removing dross and the like which is separated on the surface of the bath.

The apparatus of FIG. 1 functions as follows: Gas containing zinc vapour enters the tower 1 through inlet 2 and flows up through the tower towards the outlet 3. Liquid lead is sprayed in atomized form through the nozzles 5 and flows down through the rising gas which is thus cooled.

For maximum energy utilization, the incoming gas is preferably saturated with zinc vapour. The zinc condenses and/or is dissolved in the lead drops. The lead is then collected at the bottom of the tower 1. The quantity of lead circulating is adjusted so that the zinc vapour in the gas is caught as completely as possible and so that the zinc has the greatest possible solubility in the lead.

The cooled gas, substantially freed from zinc vapour, leaves the tower through outlet 3 while the lead containing the zinc is tapped through the pipe 7 to the chamber 8.

In the chamber 8 the lead is cooled by means of the cooling loop 9. The solubility of the zinc is thus reduced and it is therefore segregated and forms a layer on top of the lead, which can be tapped off through an outlet 10. Dross, i.e. solid contaminants of various types, are collected above the layer of zinc and are suitably raked or scraped off and removed through an outlet 11.

The temperature in the chamber 8, i.e. the temperature to which the lead shall be cooled, must be adjusted so that the zinc is not converted to solid phase. The lead relieved of its zinc then continues to the chamber 13 through the pipe 12. The chambers are preferably placed so that the lead can flow over due to gravity. In the second chamber the lead is further cooled by means of the cooling loop 14, again with the object of making maximum use of the energy.

From the chamber 13 the lead is pumped by a pump 16 through the return pipe 15 to the supply pipe 6.

The reason for the supply pipe 6 being arranged partially in the gas outlet pipe 3 is that the lead is thus preheated somewhat before reaching the nozzles 5. The resultant positive temperature gradient eliminates the risk of the nozzles becoming clogged by dross formation.

This pre-heating can be performed to a greater or lesser extent. Various arrangements of the supply pipe are thus feasible. It may run in loops, for instance, and an external heat loop may even be arranged to heat the lead externally, either in combination with the first arrangement or on its own.

FIG. 2 shows a second embodiment of apparatus for performing the method according to the invention. A first and a second cooling tower 21, 22 are connected together. The gas enters through a gas inlet 23 at the top of the first cooling tower 21. Just as in the equipment shown in FIG. 1, atomized lead is introduced through nozzles 5 arranged at the top of the cooling tower. A supply pipe 6 for lead runs a short distance through the gas inlet 23 and the nozzles 5 themselves are located some way down in the cooling tower. This ensures that the nozzles do not become clogged by dross formation.

The gas flows through a connecting pipe 24 from the bottom of the first to the bottom of the second cooling tower and then passes in counterflow to the atomized lead entering through a pipe **6*a* and nozzles 5*a* at the top of the second cooling tower. The supply pipe 6*a* runs some way through gas outlet 25 at the top of the tower 22**, for the same reason as explained above.

The lead with its zinc content is tapped off from the bottom of respective towers through pipes 7, **7*a* and is lead to a joint separating chamber 8, after which the process follows that described in connection with FIG. 1**.

FIG. 3 shows a third embodiment of the apparatus with one cooling tower 31. A partition 32 is arranged in the tower, which is attached to the top and edges of the tower but does not extend to the bottom. The partition 32 defines two chambers 33, 34. The gas enters through an inlet 35 at the top of the first chamber. Supply pipe 6 for lead passes through the inlet 35 exactly as in the previous embodiments. The gas flows down with the lead through the first chamber 33, under the lower edge of the partition 32 and up through the second chamber 34, in counter-flow to the atomized lead coming from supply pipe **6*a*. The gas leaves the twin-chamber tower 31 through outlet 36 through which a supply pipe 6*a* for lead passes partially. The equipment otherwise functions in exactly the same way as those described with reference to FIGS. 1 and 2**.

One of the big advantages with the twin-tower and twin-chamber arrangements according to FIGS. 2 and 3 is that the cooling tower need not be made so high. The zinc requires a certain contact time to be dissolved in the lead, although the process is relatively quick since the lead is atomized.

The following Example serves to illustrate the invention.

EXAMPLE

Experiments were performed using exhaust gas from a PLASMAZINC® plant used to process dust containing 10% Zn and dust containing 20% Zn.

The temperature of the gas leaving the PLASMAZINC® plant was about 1200° C. In the experiments the gas was introduced directly and with various degrees of cooling.

To make the best use of the lead, this was cooled to about 350° C. prior to recirculation and permitted to reach a temperature of 550° C., at which temperature it was tapped from the cooling tower. In the separating chamber the lead was cooled to about 450° C., whereupon the zinc was separated off in the form of a liquid layer floating on top of the lead. Upon cooling from 450° C. to 350° C. in the subsequent cooling step, a certain amount of precipitation of dross and also zinc occurred. (This is preferably recirculated to the PLASMAZINC® process.)

The exhaust gas from the dust with 10% Zn contained 71.8% CO, 23% $H_2$, 1% $N_2$, 4% $Zn_{(g)}$ and 0.2% $Pb_{(g)}$ and the exhaust gas with 20% Zn contained 67% CO, 21% $H_2$, 1% $N_2$, 10% $Zn_{(g)}$ and 1% $Pb_{(g)}$.

The Table below shows the cooling requirement for the exhaust gases with varying $Zn_{(g)}$ contents and varying entering temperatures, expressed in ton lead/1000 $m^3n$ exhaust gas. The leaving temperature of the gas from the equipment was 550° C. in all cases.

| | Cooling requirement ton Pb/1000 $m^3n$ | |
|---|---|---|
| Entry temperature for exhaust gas | 4% $Zn_{(g)}$ in exhaust gas | 10% $Zn_{(g)}$ in exhaust gas |
| 1200 | 30.3 | 40.1 |
| 950 | 21.0 | 29.6 |
| 750 | 13.7 | 23.3 |

The quantity of circulating lead can thus be reduced considerably if the temperature of the gas entering can be lowered.

The arrangement of the supply pipe for the lead is preferably such that the temperature of the lead is increased from 350° C. to 360° C. before it enters the nozzles, if used. The risk of dross formation and clogging is thus eliminated.

We claim:

1. A method of recovering zinc from a gas containing zinc vapor comprising the steps of introducing said vapor into the lower portion of a first chamber having upper and lower portions, passing said vapor upwardly through the chamber, spraying atomized lead in liquid form into the chamber by nozzle means arranged such that the lead and vapor contact each other in counter current flow thereby condensing said vapor on droplets of the lead and thereby forming a liquid lead-zinc mixture, collecting the lead-zinc mixture at the bottom of the chamber and withdrawing said mixture from the chamber; thereafter passing said mixture to a separator and cooling said mixture in said separator such that the zinc forms a layer on the top of the lead, removing the zinc layer from the top of the lead by means of a first separator outlet, and removing the lead from a second separator outlet and recycling the lead from which the zinc has been removed back into the chamber.

2. A method according to claim 1 wherein the mixture is cooled in the separator by means of cooling water loops.

3. A method according to claim 1 including the step of precooling the gas to a temperature of about 500°–550° C. prior to introducing the gas into said first chamber.

4. A method according to claim 1 wherein the mixture is cooled in the separator to a temperature of about 450° C.

5. A method according to claim 1 including the step of cooling the lead to about 350° C. prior to recycling.

6. A method according to claim 5 including the step of reheating the lead cooled to about 350° C. by means of said gas prior to introducing the gas into the chamber.

7. A method according to claim 6 in which the lead is reheated to about 360° C.

8. A method of recovering zinc from a gas containing zinc vapor comprising the steps of introducing said vapor into the upper portion of a first chamber having upper and lower portions, passing said vapor downwardly through the chamber, spraying atomized lead in liquid form into the chamber by nozzle means arranged such that the lead and vapor contact each other in cocurrent flow thereby condensing said vapor on droplets of the lead and thereby forming a liquid lead-zinc mixture, collecting the lead-zinc mixture at the bottom of the chamber and withdrawing said mixture from the chamber; thereafter passing said mixture into a separator and cooling said mixture in said separator such that the zinc forms a layer on the top of the lead, removing the zinc layer from the top of the lead by means of a first separator outlet, and removing the lead from a second separator outlet and recycling the lead from which the zinc has been removed back into the chamber.

9. A method according to claim 8 including the steps of removing uncondensed vapor from the lower portion of the first chamber and passing said vapor into the lower portion of a second chamber having upper and lower portions, said second chamber separated at least partially from said first chamber, passing said vapor upwardly through the second chamber, spraying atomized lead in liquid form into the second chamber by nozzle means arranged such that the lead and vapor contact each other in counter current flow thereby condensing the vapor on droplets of the lead and thereby forming a liquid lead-zinc mixture, collecting the lead-zinc mixture at the bottom of the second chamber and withdrawing said mixture from the second chamber; and thereafter passing said mixture to a separator and cooling said mixture in said separator such that the zinc forms a layer on the top of the lead, removing the zinc layer from the top of the lead by means of a first separator outlet, and removing the lead from a second separator outlet and recycling the lead from which the zinc has been removed back into the chamber.

10. A method according to claim 9 wherein the lead is collected at the bottom of the first chamber and the second chamber in a single reservoir.

11. A method according to claim 9 including the step of precooling the gas to a temperature of about 500°–550° C. prior to including the gas into said first chamber.

12. A method according to claim 9 wherein the mixture is cooled in the separator to a temperature of about 450° C.

13. A method according to claim 9 wherein the mixture is cooled in the separator by means of cooling water loops.

14. A method according to claim 9 including the step of cooling the lead to about 350° C. prior to recycling.

15. A method according to claim 14 including the step of reheating the lead cooled to about 350° C. by means of said gas prior to introducing the gas into the chamber.

16. A method according to claim 15 in which the lead is reheated to about 360° C.

* * * * *